US008891775B2

(12) United States Patent
Schug et al.

(10) Patent No.: US 8,891,775 B2
(45) Date of Patent: Nov. 18, 2014

(54) METHOD AND ENCODER FOR PROCESSING A DIGITAL STEREO AUDIO SIGNAL

(75) Inventors: Michael Schug, Erlangen (DE); Harald H. Mundt, Fürth (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/113,362

(22) PCT Filed: May 7, 2012

(86) PCT No.: PCT/EP2012/058391

§ 371 (c)(1),
(2), (4) Date: Oct. 22, 2013

(87) PCT Pub. No.: WO2012/152764

PCT Pub. Date: Nov. 15, 2012

(65) Prior Publication Data

US 2014/0072120 A1 Mar. 13, 2014

Related U.S. Application Data

(60) Provisional application No. 61/484,171, filed on May 9, 2011.

(51) Int. Cl.

| | |
|---|---|
| ***H04S 1/00*** | (2006.01) |
| ***G10L 19/008*** | (2013.01) |
| ***G10L 19/03*** | (2013.01) |

(52) U.S. Cl.

CPC ..... *H04S 1/007* (2013.01); *G10L 19/008* (2013.01); *G10L 19/03* (2013.01)

USPC ..... 381/1; 381/22; 381/23; 381/17; 700/84; 704/229; 704/500; 704/219; 704/200.1; 704/501

(58) Field of Classification Search

USPC ..... 381/22–23, 1, 17; 700/94; 704/229, 704/500, 219, 200.1, 501

See application file for complete search history.

(56) References Cited

U.S. PATENT DOCUMENTS 6,502,069 B1 * 12/2002 Grill et al. ..... 704/219
6,750,789 B2 6/2004 Herre (Continued)

FOREIGN PATENT DOCUMENTS

DE 19829284 C2 * 3/2000

OTHER PUBLICATIONS

Geiger et al, Scalable Perceptual and Lossless Audio Coding based on MPEG-4, AAC ,AES 2003.*

(Continued)

*Primary Examiner* — Davetta W Goins
*Assistant Examiner* — Kuassi Ganmavo

(57) ABSTRACT

The invention discloses a method and an encoder for processing a digital audio stereo signal. A digital audio encoder for coding such audio signal comprises a predictive Temporal Noise Shaping (TNS) filter, a Mid-/Side (M/S) coding unit, a control unit for determining a first prediction gain related to the unmodified L/R signal processed by the TNS filter and for determining a second prediction gain related to the M/S-coded L/R signal processed by the TNS filter, wherein the control unit is adapted to disable TNS-filtering—i.e. to bypass the TNS filter—for a current signal frame, if the first and second prediction gains differ by more than a pre-determined mismatch range. Preferably, the first and second prediction gains are determined from signal energy ratios calculated for each channel of the stereo signal including the signal energies of both the TNS-processed (unmodified) L- respectively (unmodified) R-signal and the TNS-processed M/S coded L- respectively M/S coded R-signal divided by the respective signal energies before TNS processing. Furthermore, the control unit is preferably adapted to overrule the disabling of the TNS filter, if the input signal is a near-mono audio signal exhibiting only low energy either in its M- or S-band. In that case, operation of the TNS filter on the stereo audio signal is maintained.

20 Claims, 1 Drawing Sheet

(56) References Cited

U.S. PATENT DOCUMENTS

| | | | | |
|---|---|---|---|---|
| 6,772,111 | B2 * | 8/2004 | Araki | 704/200.1 |
| 7,099,830 | B1 * | 8/2006 | Johnston et al. | 704/500 |
| 7,318,028 | B2 | 1/2008 | Schug | |
| 7,340,391 | B2 * | 3/2008 | Herre et al. | 704/200.1 |
| 7,574,355 | B2 | 8/2009 | Grill | |
| 7,613,603 | B2 * | 11/2009 | Yamashita | 704/200.1 |
| 7,835,915 | B2 * | 11/2010 | Kim et al. | 704/500 |
| 7,983,424 | B2 * | 7/2011 | Kjorling et al. | 381/22 |
| 2003/0215013 | A1 * | 11/2003 | Budnikov | 375/240.16 |
| 2006/0047522 | A1 * | 3/2006 | Ojanpera | 704/503 |
| 2008/0004870 | A1 | 1/2008 | Liu | |
| 2009/0226010 | A1 | 9/2009 | Schnell | |
| 2009/0228285 | A1 | 9/2009 | Schnell | |
| 2009/0274210 | A1 * | 11/2009 | Grill et al. | 375/240.03 |
| 2010/0094637 | A1 * | 4/2010 | Vinton | 704/500 |
| 2011/0178795 | A1 * | 7/2011 | Bayer et al. | 704/205 |
| 2013/0332153 | A1 * | 12/2013 | Markovic et al. | 704/219 |

OTHER PUBLICATIONS

Niamut O A et al. "RD Optimal Temporal Noise Shaping for Transform Audio Coding", Acoustics, Speech and Signal Processing May 14, 2006, p. 190-191.

Herre J. et al. "Enhancing the Performance of Perceptual Audio Coders by Using Temporal Noise Shaping" Nov. 8, 1996, pp. 1-24.

* cited by examiner

METHOD AND ENCODER FOR PROCESSING A DIGITAL STEREO AUDIO SIGNAL

FIELD OF INVENTION

The invention relates to a system and method for processing a digital signal, especially a digital audio signal having L(eft) and R(ight) channels.

BACKGROUND OF INVENTION

Digital processing of multi-channel signals reveals additional challenges as compared to processing single-channel signals. For example, artifacts masked in single channel coding may become audible or visible when presented as a multi-channel signal encoded as a dual mono. This relates to the difference between the masked threshold in a mono-signal presentation and the masked threshold in a multi-channel-signal presentation such as binaural listening. This effect is often referred to as the "cocktail party effect", meaning that a person is usually able to overhear also more quiet conversations in presence of louder background noise using both ears as opposed to his/her ability with one ear plugged.

Many coding concepts of multi-channel digital signal processing aim at achieving a high coding gain while not raising the bit rate, including e.g. to dynamically allocate quantization noise to such frequency bands exhibiting amplitudes under a recognizable threshold—thus being inaudible or invisible.

In the frequency domain, the known concept of Temporal Noise Shaping (TNS) aims at further improving predictive coding techniques by enhancing the temporal resolution of a coder achieved by (adaptive prediction) TNS-filtering of the spectral coefficients of an input signal: The temporal shape of the quantization error will thus appear adapted to the temporal shape of the input signal as the quantization noise in time will be effectively localized under the actual signal, resulting in an efficient masking effect.

However, TNS filtering can also bring about disadvantages as it might increase the permissible or desired amount of side information to be transmitted to the decoder. Or, e.g. in M(id)/S(ide) stereo audio coding, quantization noise could yield audible unmasking artifacts after inverse TNS-filtering in the decoder.

PRIOR ART

US7340391B2 discloses an apparatus and method of processing a multi-channel signal using a common TNS-filter for both L(eft) and R(ight) channels if the magnitude of the absolute or relative difference between the predictive gains of the L respectively R channel lies below a predetermined threshold; i.e. a common TNS-filter is employed for both L and R channel if both channels are judged as being similar. Otherwise, distinct TNS-filters are used for each channel.

SUMMARY OF INVENTION

It is an object of the invention to further improve stereo audio coding in multi-channel signal processing applications, especially in M/S-audio coding combined with TNS-filtering applications involving the processing of transient signals.

Specifically, it is another object of the invention to avoid unwanted artifacts generated by a decoder when processing coded transient signals.

This object is achieved by method for processing a digital stereo audio Left/Right signal (L/R) by a digital encoder, the encoder comprising a predictive Temporal Noise Shaping (TNS) filter and a Mid-/Side (M/S) coding unit, the method comprising: Determining a first prediction gain related to the unmodified L/R signal processed by the TNS filter; determining a second prediction gain related to the M/S-coded L/R signal processed by the TNS filter; and disabling TNS-filtering—i.e. bypassing TNS-filtering—for a current signal frame if the first and second prediction gains differ by more than a pre-determined mismatch range.

The term "stereo audio Left/Right (L/R) signal" may refer to any pair of audio channels to which M/S coding is applied, such as the left and right channels of a 2-channel audio signal or the Left Surround and Right Surround channels of a multichannel audio signal.

As far as the mismatch range is concerned, it will preferably be chosen to lie around at least 1 dB, e.g. within the range of 1-10 dB. The mismatch range can also be (pre-) determined to be a single mismatch threshold value. Good results have been achieved and can be expected for a mismatch range chosen from the range of 3-5 dB, preferably for a mismatch range equaling substantially the mismatch threshold value of 3 dB.

Typically, the second prediction gain might be calculated first (TNS-filtering and M/S coding active) to be compared to the first prediction gain (TNS-filtering active and M/S-coding inactive/bypassed) in a consecutive step. To that end, it is advantageous for speedy calculation time to store—for each current signal frame—the unmodified L/R signal(s) and/or the TNS-filtered L/R signal(s) for the consecutive calculation step.

Preferably, the first prediction gain includes a first prediction gain measure related to the unmodified L-signal processed by the TNS filter and a second prediction gain measure related to the unmodified R-signal processed by the TNS filter; and the second prediction gain includes a third prediction gain measure related to the M/S coded L-signal—e.g. the M-signal—processed by the TNS filter and a fourth prediction gain measure related to the M/S coded R-signal—e.g. the S-signal—processed by the TNS filter.

In this embodiment, we intend to compare the TNS prediction gains calculated for each channel of the TNS-filtered (unmodified) L/R-signal and for each channel of the TNS-filtered and M/S-coded L/R signal, resulting in four prediction gain measures which may (at least a sub-set thereof) consecutively be compared to each other.

Disabling of the TNS filter is therefore executed, if for example at least one of the prediction gain measures differs from all or some of the remaining prediction gain measures by more than the pre-determined mismatch range.

In a further preferred embodiment, said prediction gains are related to signal energy ratios, which can easily be calculated. Thus, determining the first and second prediction gains in this embodiment comprises: Calculating a first signal energy ratio by determining a first signal energy related to the L/R signal processed by the TNS filter divided by a second signal energy related to the unmodified L/R signal, and calculating a second signal energy ratio by determining a third signal energy related to the M/S-coded L/R signal processed by the TNS filter divided by a fourth signal energy related to the M/S-coded L/R signal.

In such embodiment, said signal energy ratios are further preferably calculated on a per-channel-basis, wherein the first signal energy ratio includes a first signal energy ratio measure related to a first signal energy related to the L-signal processed by the TNS filter divided by a second signal energy related to the unmodified L-signal and a second signal energy ratio measure related to a third signal energy related to the R-signal processed by the TNS filter divided by a fourth signal energy related to the unmodified R-signal, and the second signal energy ratio includes a third signal energy ratio measure related to a fifth signal energy related to the M-signal of the M/S coded L/R-signal processed by the TNS filter divided by a sixth signal energy related to the M-signal of the M/S-coded L/R-signal and a fourth signal energy ratio measure related to a seventh signal energy related to the S-signal of the M/S coded L/R-signal processed by the TNS filter divided by an eighth signal energy related to the S-signal of the M/S-coded L/R-signal.

As outlined earlier, this corresponds to comparing signal energy ratios obtained from per-channel signal energies obtained for M/S-coded and not M/S coded signals, which can easily be calculated.

Hereby, the disabling of the TNS filter—and therefore bypassing the TNS filter—is preferably executed if at least one of the signal energy ratio measures differs from at least some of the remaining signal energy ratio measures by more than the pre-determined mismatch range.

The invention is especially effective when the TNS filter includes equal filters for processing each channel of the L/R-signal.

In thus embodiment, the inventive method reveals good results as to judge whether the S- or M-channel might incur unwanted amplification of inherent quantization noise and make the TNS-disabling decision accordingly.

It is also advantageous if the L/R signal is obtained from an analysis filterbank including a number of analysis filters related to a number of frequency bands.

In a further embodiment, the first and second prediction gains are calculated relative to each frequency band for which the TNS filter is provided. In other words, it is not necessarily the case to provide TNS filtering or/and M/S coding for the whole frequency spectrum of an audio stereo input signal. The invention therefore applies only to selected frequency bands. It may be selectively decided if and which one or more frequency bands of the audio stereo input signal will be used and processed by a prescribed method according to the invention. This further refines accuracy of TNS-disabling decisions and may avoid disabling of TNS filtering for specific frequency bands of the input signal where processing of the full frequency range input signal according to the invention might have disabled the TNS-filter filter for the input signal altogether. Consequently, such embodiment of the invention includes determining and comparing the first and second prediction gains relative to at least one of the frequency bands, preferably to at least two of the frequency bands but not for all.

The invention disclosed so far might reveal a TNS-disabling decision also for quasi-mono input signals. Under those circumstances, where the S- or M-channel signal energy is very low and consequently were quantized to zero, TNS-disabling is not necessary under such circumstances and shall be overruled in a further preferred embodiment. Such further improvement of the invention therefore foresees overruling the disabling decision regarding the TNS filtering for the current signal frame despite the first and second prediction gains differ by more than the pre-determined mismatch range, if a signal energy related to the M-channel or to the S-channel of the M/S coded L/R signal falls below a predetermined (preferably very low) signal energy threshold.

Such signal energy threshold can for example be chosen to lie around the so-called hearing threshold in quiet.

The various concepts outlined for the invention are based on the knowledge that quantization noise might get amplified and unwantedly audible by inverse TNS filtering in the decoder. Especially highly transient signals with both high TNS prediction gain and also high M/S coding gain might cause the decoder to be prone to creating such annoying artifacts. The present invention and its manifold embodiments provide for detecting such situations in the encoder, and consequently disable TNS filtering for a current frame in such situations where Temporal Noise Shaping (TNS) in an M/S stereo coding application would decrease the sound quality instead of improving it.

An appropriate measure for determining such TNS disabling includes comparing said signal energy ratios calculated for an active and a bypassed TNS filter. If there appears to be a significant mismatch between at least some of the calculated signal energy ratios, TNS filtering will be bypassed for the current signal frame. If TNS filters for both channels of the stereo audio signal are equal—e.g. as a design requirement—; this is equivalent to applying the same TNS filter to both channels of the stereo audio signal. A variety of different transient signal types result in a high M/S coding gain, and equal TNS filters for both signals channels may result also in a high TNS prediction gain. One initial drawback is that quantization noise might be boosted by the TNS filtering process such that the S- or M-channel channel signal energy after TNS-filtering might finally be (significantly) larger than the original S- respectively M-channel signal energy, possibly resulting in said annoying audible artefacts when decoding.

The present invention takes care of avoiding such a situation by selectively disabling—and therefore bypassing—TNS filtering for a current frame. But for quasi-mono signals, hence for such signals having a very low S- or M-channel energy, disabling of TNS-filtering shall be overruled as such very low S- respectively M-channel signal energy will be quantized to (near) zero and therefore no significant amplification of an S- respectively M-channel related quantization error will occur.

The object of the invention is further achieved by a digital encoder for processing a digital stereo audio Left-/Right signal (L/R), comprising a predictive Temporal Noise Shaping (TNS) filter, a Mid-/Side (M/S) coding unit, a control unit for determining a first prediction gain related to the unmodified L/R signal processed by the TNS filter and for determining a second prediction gain related to the M/S-coded L/R signal processed by the TNS filter, wherein the control unit is adapted to disable TNS-filtering for a current signal frame if the first and second prediction gains differ by more than a pre-determined mismatch range.

With regard to the proposed encoder according, all previously described embodiments of the method according to the invention are also applicable to and operative with the proposed encoder, leading to a variety of preferred encoder embodiments.

BRIEF DESCRIPTION OF THE DRAWINGS

The invention is described and explained in more detail below on the basis of the exemplary embodiment shown in the figures.

The figures show.

DETAILED DESCRIPTION OF INVENTION

Figure 1:
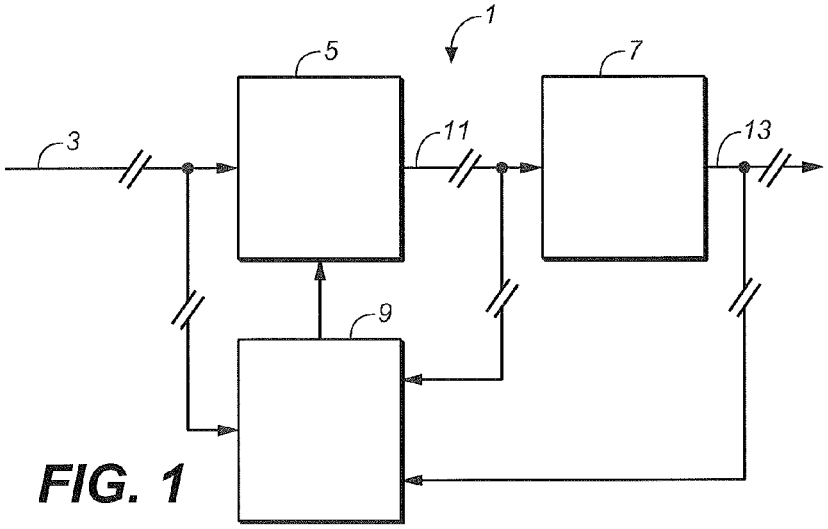
FIG. 1 an encoder for processing a digital stereo audio signal.

FIG. 1 depicts an encoder 1 including a TNS filter 5, a Mid/Side- (M/S-) coding unit 7 and a control unit 9.

A stereo audio signal 3 having L- and R-channels is fed to the TNS filter 5 for executing Temporal Noise Shaping operations. Signal 3 may e.g. originate from the output channels of a filterbank (not shown here) so that the encoder schematically depicted in FIG. 1 selectively applies TNS filtering to one or more frequency bands of an input signal, but not necessarily to all. So signal 3 reflects at least one frequency band of the input signal fed to the TNS filter 5 which may include equal filters for all channels of signal 3, e.g. as a result of design requirements.

The output signal 11 generated by the TNS filter 5 is further processed by the M/S coding unit 7 creating an M/S coded signal 13 having M- and S-channels. In case the TNS filter 5 is disabled, the output signal 11 reflects the un-filtered signal 3, i.e. the TNS filter is bypassed in such case.

The invention is adapted to control use of the TNS filter 5 by selectively switching it off (i.e. bypassing it) for a current signal frame. This is achieved by a control unit 9 operatively connected to the TNS filter 5. In order to create a TNS-disabling decision, the control unit 9 determines a first prediction gain related to the unmodified L/R signal processed by the TNS filter. It also determines a second prediction gain related to the M/S-coded L/R signal processed by the TNS filter.

In other words, for at least the current signal frame and preferably for all subsequently occurring signal frames, the control unit looks into the prediction gains obtained by TNS-filtering a) with M/S coding applied, and b) with M/S coding switched off.

If the first and second prediction gains differ by more than a pre-determined mismatch range, the control unit 9 will disable (i.e. bypass) the TNS filter 5 for the current signal frame resulting in signal 3 being unfiltered and equaling signal 11.

The first and second prediction gains are suitable indicators to judge whether TNS filtering in the presence of M/S coding will actually improve or even worsen the coding results. If said prediction gains differ significantly for a current signal frame, TNS-disabling is a good choice.

It has been found out that there is a strong correlation between said prediction gains and signal energy ratios calculated for the TNS-filtered signals with M/S coding applied and with M/S coding switched off:

Therefore, the control unit 9 is preferably adapted to calculate a) a first signal energy ratio by determining a first signal energy related to the L/R signal processed by the TNS filter divided by a second signal energy related to the unmodified L/R signal; and b) a second signal energy ratio by determining a third signal energy related to the M/S-coded L/R signal processed by the TNS filter divided by a fourth signal energy related to the M/S-coded L/R signal.

If said first and second signal energy ratios differ (significantly), this is a strong indication that subsequent TNS filtering might generate unwanted audible artifacts by boosting quantization noise included in the S- or M-channel. This is especially true for (highly) transient input signals.

In such situations, the control unit 9 disables TNS-filtering for the current signal frame based on said comparison result. To that end, the control unit includes a—preferably editable—mismatch range variable indicative of a maximum tolerable difference of said first and second signal energy ratios. First and second signal energy ratios can be regarded as cumulative measures relative to the respective stereo signals.

As the encoder 1 is designed for processing audio stereo signals, said signal energy ratios shall preferably be determined relative to each channel of signals 3, 11 and 13.

As a consequence, this per-channel approach reveals in fact four signal energy ratios—called signal energy ratio measures in the following—including eight signal energies:

The first signal energy ratio includes a first signal energy ratio measure related to a first signal energy related to the L-signal processed by the TNS filter divided by a second signal energy related to the unmodified L-signal, and a second signal energy ratio measure related to a third signal energy related to the R-signal processed by the TNS filter divided by a fourth signal energy related to the unmodified R-signal.

In the same manner, the second signal energy ratio includes a third signal energy ratio measure related to a fifth signal energy related to the M-signal of the M/S coded L/R-signal processed by the TNS filter divided by a sixth signal energy related to the M-signal of the M/S-coded L/R-signal, and a fourth signal energy ratio measure related to a seventh signal energy related to the S-signal of the M/S coded L/R-signal processed by the TNS filter divided by an eighth signal energy related to the S-signal of the M/S-coded L/R-signal.

There are now four signal energy ratio measures available relating to a per-channel comparison. A comparison mismatch—and thus creating a trigger signal for the control unit 9 causing the TNS filter 5 to be disabled/bypassed—can now be defined by comparing any subset of said four signal energy ratio measures to any (or all) of the remaining signal energy ratio measures. The actual choice of the signal energy ratios to be compared to each other for determining a violation of the mismatch range might depend on the actual circumstances like design and structure of the TNS filter, type of input signal 3 etc. and can be evaluated e.g. in a test series.

The control unit 9 is programmed to overrule its decision for disabling the TNS filter 5 for the current signal frame despite a determined mismatch, if a S- channel or M-channel signal energy falls below a predetermined (very low!) energy threshold. In such embodiment, the audio stereo input signal 3 represents a quasi-mono audio signal exhibiting only (very) low signal energy in either S- or M-channel. Overruling a disabling decision and consequently allowing TNS filtering improves audio coding quality in such a situation as the (very) low S- or M-band energy of such audio input signal will be quantized to (near) zero, avoiding unwanted audible artifacts.

Figure 2:
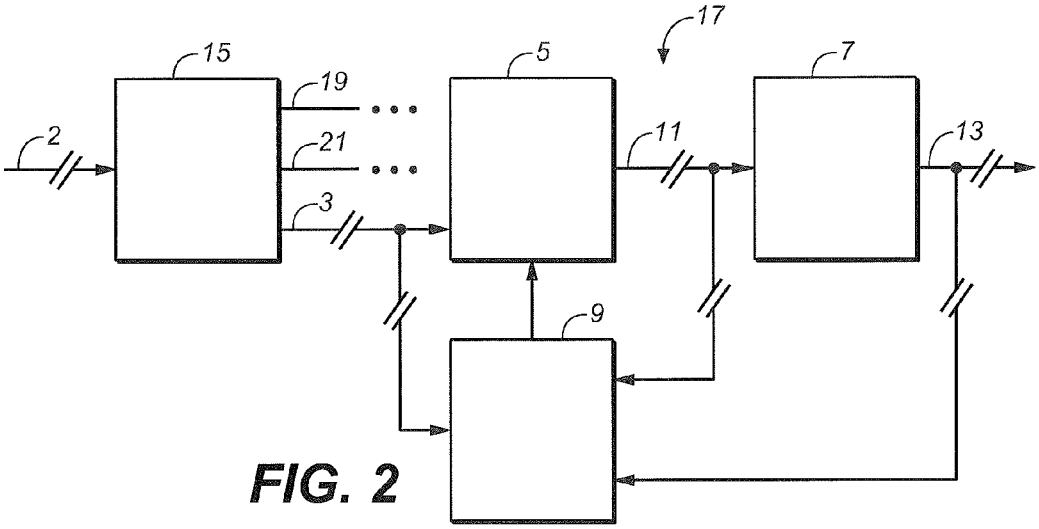
FIG. 2 an encoder including a filterbank for frequency-selective TNS filtering.

FIG. 2 includes the basic outline of the encoder as depicted in FIG. 1; corresponding elements will have the same numerals as in FIG. 1 and exhibiting the same functionality.

Here, we have now added a filterbank 15 at the input side of the encoder resulting in an encoder 17 applying TNS-filtering only to selected frequency bands of a stereo audio input signal 2.

Signal 3 as an output signal of the filterbank 15 therefore reflects the input signal 2 relative to a selected frequency band and corresponds to the equally numbered signal depicted and described in FIG. 1.

The filterbank 15 has further outputs designated 19 and 21. Those outputs 19, 21 reflect other frequency bands of the input signal 2.

As an example, output 19 and/or output 21 may bypass the TNS filter 5 and directly be fed to the M/S coding unit 7—or even further processed otherwise.

It is also possible to process output 19 and/or output 21 in the same manner as described for signal 3.

In many applications, TNS filtering will be applied not to all but only to selected frequency bands of the input signal 2. This flexibility shall be reflected by the outputs 19, 21 not having a fixed destination.

A person skilled in the art will easily be able to apply the various concepts outlined above to reach further embodiments specifically adapted to current audio coding requirements.

We claim:

1. A method for processing a digital stereo audio Left-/Right signal (L/R) by a digital encoder, the encoder comprising a predictive Temporal Noise Shaping (TNS) filter and a Mid-/Side (M/S) coding unit, the method comprising:

determining a first prediction gain for a current signal frame by comparing the L/R signal and to the L/R signal processed by the TNS filter;

determining a second prediction gain for the current signal frame by comparing an M/S-coded version of the L/R signal and an M/S-coded version of the L/R signal processed by the TNS filter; and disabling TNS-filtering for the current signal frame if the first and second prediction gains differ by more than a pre-determined mismatch range.

2. The method according to claim 1, wherein the first prediction gain includes a first prediction gain measure determined by comparing the L-signal and the L-signal processed by the TNS filter and a second prediction gain measure determined by comparing the R-signal and the R-signal processed by the TNS filter; and the second prediction gain includes a third prediction gain measure determined by comparing the M-signal of the M/S-coded version of the L/R-signal and the M-signal of the M/S coded version of the L/R-signal processed by the TNS filter and a fourth prediction gain measure determined by comparing the S-signal of the M/S-coded version of the L/R-signal and the S-signal of the M/S coded version of the L/R-signal processed by the TNS filter.

3. The method according to claim 2, wherein the disabling of the TNS filter is executed if at least one of the prediction gain measures differs from the remaining prediction gain measures by more than the pre-determined mismatch range.

4. The method according to claim 1, wherein determining the first and second prediction gains comprises:

calculating a first signal energy ratio as a signal energy of the L/R signal processed by the TNS filter divided by a signal energy of the L/R signal;

and calculating a second signal energy ratio as a signal energy of the M/S-coded version of the L/R signal processed by the TNS filter divided by a signal energy of the M/S-coded version of the L/R signal.

5. The method according to claim 4, wherein the first signal energy ratio includes a first signal energy ratio measure calculated as a signal energy of the L-signal processed by the TNS filter divided by a signal energy of the L-signal and a second signal energy ratio measure calculated as a signal energy of the R-signal processed by the TNS filter divided by a signal energy of the R-signal; and the second signal energy ratio includes a third signal energy ratio measure calculated as a signal energy of the M-signal of the M/S coded version of the L/R-signal processed by the TNS filter divided by a signal energy of the M-signal of the M/S-coded version of the L/R-signal and a fourth signal energy ratio measure calculated as a signal energy of the S-signal of the M/S coded version of the L/R-signal processed by the TNS filter divided by a signal energy of the S-signal of the M/S-coded version of the L/R-signal.

6. The method according to claim 5, wherein the disabling of the TNS filter is executed if at least one of the signal energy ratio measures differs from the remaining signal energy ratio measures by more than the pre-determined mismatch range.

7. The method according to claim 5, wherein disabling the TNS filtering for the current signal frame is overruled despite the first and second prediction gains differ by more than the pre-determined mismatch range, if the signal energy of the M-channel of the M/S coded version of the L/R signal falls below a first pre-determined signal energy threshold.

8. The method according to claim 5, wherein disabling the TNS filtering for the current signal frame is overruled despite the first and second prediction gains differ by more than the pre-determined mismatch range, if the signal energy of the S-channel of the M/S coded version of the L/R signal falls below a second pre-determined signal energy threshold.

9. The method according to claim 1, wherein the TNS filter includes equal filters for processing each channel of the L/R-signal.

10. The method according to claim 1, wherein the L/R signal is obtained from an analysis filterbank including a number of analysis filters related to a number of frequency bands.

11. The method according to claim 10, wherein the first and second prediction gains are calculated relative to each frequency band for which the TNS filter is provided.

12. A digital encoder for processing a digital stereo audio Left-/Right signal (L/R), comprising:

a predictive Temporal Noise Shaping (TNS) filter;

a Mid-/Side (M/S) coding unit;

a control unit for determining a first prediction gain of a current signal frame by comparing the L/R signal and the L/R signal processed by the TNS filter and for determining a second prediction gain of the current signal frame by comparing an M/S-coded version of the L/R signal and an M/S coded version of the L/R signal processed by the TNS filter, wherein the control unit is adapted to disable TNS-filtering for the current signal frame if the first and second prediction gains differ by more than a pre-determined mismatch range.

13. The digital encoder according to claim 12, wherein the first prediction gain includes a first prediction gain measure determined by comparing the L-signal and the L-signal processed by the TNS filter and a second prediction gain measure determined by comparing the R-signal and the R-signal processed by the TNS filter; and the second prediction gain includes a third prediction gain measure determined by comparing the M-signal of the M/S coded version of the L/R signal and the M-signal of the M/S coded version of the L/R-signal processed by the TNS filter and a fourth prediction gain measure determined by comparing the S-signal of the M/S coded version of the L/R signal and the S-signal of the M/S coded version of the L/R signal processed by the TNS filter.

14. The digital encoder according to claim 13, wherein the control unit is adapted to disable the TNS filter for the current signal frame if at least one of the prediction gain measures differs from the remaining prediction gain measures by more than the pre-determined mismatch range.

15. The digital encoder according to claim 12, wherein determining the first and second prediction gains comprises:

calculating a first signal energy ratio as a signal energy of the L/R signal processed by the TNS filter divided by a signal energy of the L/R signal; and calculating a second signal energy ratio as a signal energy of the M/S-coded version of the L/R signal processed by the TNS filter divided by a signal energy of the M/S-coded version of the L/R signal.

16. The digital encoder according to claim 15, wherein the first signal energy ratio includes a first signal energy ratio measure calculated as a signal energy of the L-signal processed by the TNS filter divided by a signal energy of the L-signal and a second signal energy ratio measure calculated as a signal energy of the R-signal processed by the TNS filter divided by a signal energy of the R-signal; and the second signal energy ratio includes a third signal energy ratio measure calculated as a signal energy of the M-signal of the M/S coded version of the L/R-signal processed by the TNS filter divided by a signal energy of the M-signal of the M/S-coded version of the L/R-signal and a fourth signal energy ratio measure related to calculated as a signal energy of the S-signal of the M/S coded version of the L/R-signal processed by the TNS filter divided by a signal energy of the S-signal of the M/S-coded version of the UR-signal.

17. The digital encoder according to claim 16, wherein the control unit is adapted to disable the TNS filter for the current signal frame if at least one of the signal energy ratio measures differs from the remaining signal energy ratio measures by more than the pre-determined mismatch range.

18. The digital encoder according to claim 16, wherein the control unit is adapted to overrule disabling the TNS filtering for the current signal frame despite the first and second prediction gains differ by more than the pre-determined mismatch range, if either the signal energy of the M-channel of the M/S coded version of the L/R signal falls below a pre-determined signal energy threshold, or the signal energy of the S-channel of the M/S coded version of the L/R signal falls below a pre-determined signal energy threshold.

19. The digital encoder according to claim 12, wherein the TNS filter includes equal filters for processing each channel of the L/R-signal.

20. The digital encoder according to claim 12, further comprising an analysis filterbank including a number of analysis filters related to a number of frequency bands, wherein the first and second prediction gains are calculated relative to each frequency band for which the TNS filter is provided.

* * * * *